US007503194B2

(12) United States Patent
McNeil

(10) Patent No.: US 7,503,194 B2
(45) Date of Patent: Mar. 17, 2009

(54) MULTIPLE PADLOCK LOCK SYSTEM

(76) Inventor: Randy L. McNeil, 916 Juniper La., Estes Park, CO (US) 80517

( * ) Notice: Subject to any disclaimer, the term of this patent is extended or adjusted under 35 U.S.C. 154(b) by 0 days.

(21) Appl. No.: 12/038,167

(22) Filed: Feb. 27, 2008

(65) Prior Publication Data

US 2008/0264116 A1 Oct. 30, 2008

(51) Int. Cl.
*E05B 65/48* (2006.01)

(52) U.S. Cl. ..... 70/2; 70/14; 70/18; 70/19; 70/101; 70/180; 70/203; 70/DIG. 63; 248/552; 292/205; 292/263; 292/281; 292/288; 292/289; 292/DIG. 13

(58) Field of Classification Search ..... 70/2, 70/14, 18, 19, 91, 101, 129, 177, 180, 200, 70/203, 212, DIG. 12, DIG. 63, DIG. 65; 248/552; 292/148, 205, 262, 263, 266, 269, 292/273, 281–284, 288, 289, 295, DIG. 13
See application file for complete search history.

(56) References Cited

U.S. PATENT DOCUMENTS

| | | | | | |
|---|---|---|---|---|---|
| 1,480,149 | A | * | 1/1924 | Carpenter | 70/203 |
| 1,527,992 | A | * | 3/1925 | Norton | 70/200 |
| 1,961,041 | A | | 5/1934 | Gilbert, Jr. | |
| 2,707,125 | A | | 4/1955 | Ritter | |
| 2,856,220 | A | | 10/1958 | Easley | |
| 2,963,895 | A | | 12/1960 | Thomas | |
| 3,695,070 | A | * | 10/1972 | Desroches | 70/164 |
| 3,889,497 | A | | 6/1975 | Tuttle | |
| 3,926,018 | A | | 12/1975 | Joersz | |
| 3,988,031 | A | | 10/1976 | Meyer | |
| 4,008,589 | A | * | 2/1977 | Harrell | 704/424 |
| 4,085,599 | A | | 4/1978 | Fischer et al. | |
| D267,698 | S | | 1/1983 | Domes | |
| D268,478 | S | | 4/1983 | Domes | |
| 4,697,443 | A | | 10/1987 | Hillin | |
| 4,741,564 | A | | 5/1988 | Alford | |
| 4,864,834 | A | * | 9/1989 | Waite | 70/14 |
| 4,997,219 | A | | 3/1991 | Carter | |
| 5,141,119 | A | * | 8/1992 | Milazzo | 212/290 |
| 5,582,042 | A | * | 12/1996 | Mordick | 70/14 |
| 5,613,386 | A | * | 3/1997 | Mire, Sr. | 70/232 |
| 5,743,116 | A | | 4/1998 | Suster | |
| 5,868,015 | A | | 2/1999 | Eaker | |
| 6,092,402 | A | * | 7/2000 | Porcelli et al. | 70/18 |
| 6,755,053 | B1 | * | 6/2004 | Dias | 70/14 |
| 6,862,906 | B2 | * | 3/2005 | Lindkjolen | 70/58 |
| 6,915,670 | B2 | * | 7/2005 | Gogel | 70/32 |
| 7,000,440 | B2 | | 2/2006 | Martin | |
| 7,194,877 | B1 | | 3/2007 | Cottrell | |
| 2006/0218983 | A1 | * | 10/2006 | Horne | 70/203 |

* cited by examiner

*Primary Examiner*—Lloyd A Gall
(74) *Attorney, Agent, or Firm*—Ancel W. Lewis, Jr.

(57) ABSTRACT

A multiple padlock lock system for locking a first post to a second post has a common plate and connecting links. Padlocks connect the common plate and the connecting links around the first post lock the common plate to the first post. Connecting links or a tongue plate lock the common plate to the second post. At least two padlocks must be unlocked to remove the lock system.

12 Claims, 5 Drawing Sheets

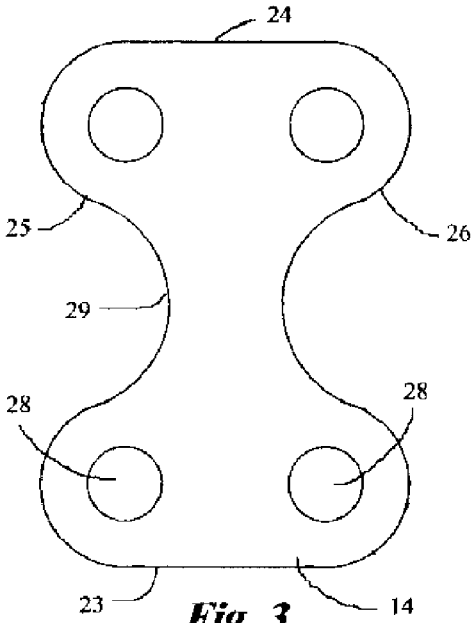
Fig. 3
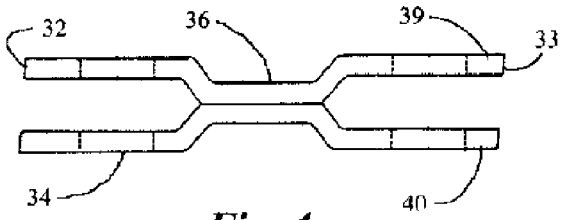
Fig. 4
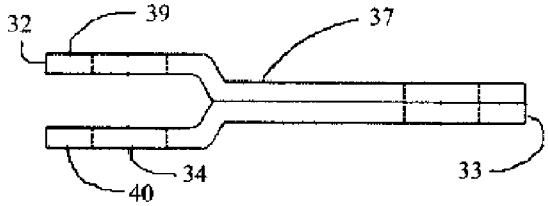
Fig. 5
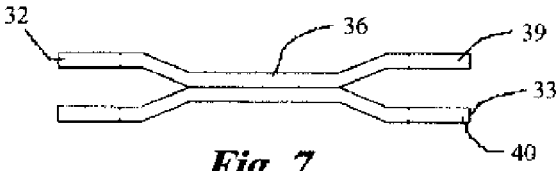
Fig. 7
Fig. 6
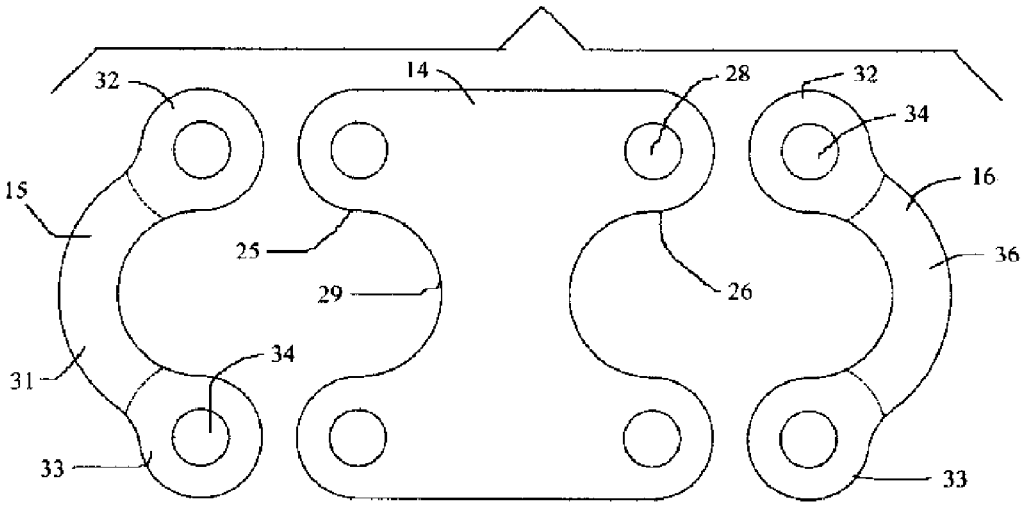

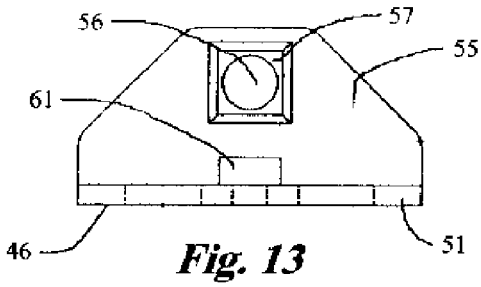
Fig. 13
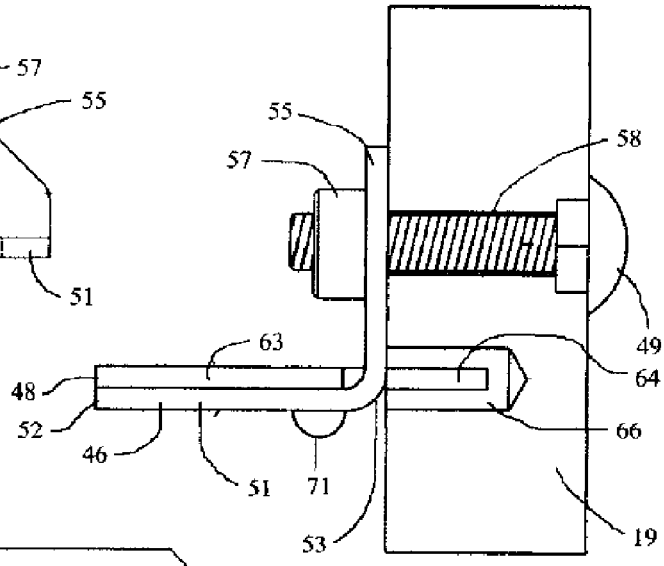
Fig. 10
Fig. 11
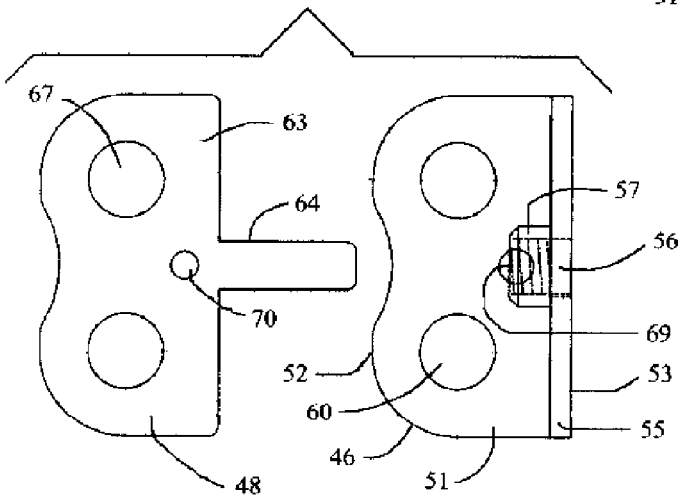
Fig. 12
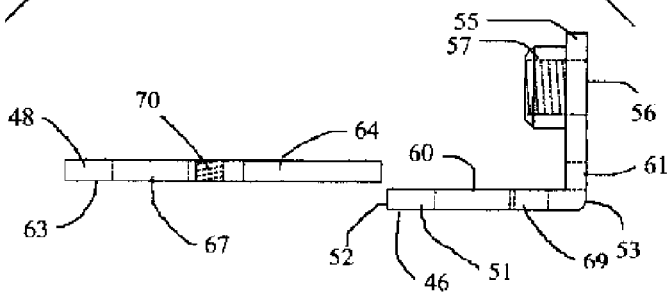

MULTIPLE PADLOCK LOCK SYSTEM

This application claims the benefit under 35 U.S.C. §119 (e) of the U.S. provisional patent application No. 60/914,390 filed Apr. 27, 2007, for the disclosure set forth therein.

TECHNICAL FIELD

The present invention relates to locking devices and more particularly to a lock system for use with multiple padlocks.

BACKGROUND ART

Multiple lock systems are used to allow access to an area by multiple users while preventing access to unauthorized persons. Such systems may be used, for example, on property with oil and gas leases, hunting leases, or wireless communications towers. One advantage of multiple lock systems over a single lock system is that a user authorized to access multiple areas may use locks with the same key for each area, eliminating the need for that user to carry multiple keys and reducing confusion over which key provides access to which area. Another advantage is that when a user is no longer authorized to access the area, the user's lock can be replaced or eliminated, and the distribution of new keys to all of the other users is not required.

One simple prior known multiple lock system uses a chain around a gatepost and a post on a gate secured by multiple padlocks linked in series with each user having their own padlock and key. One disadvantage of this system is that a user may bypass one or more locks when resecuring the chain, thereby preventing access to the users of the bypassed locks. Another disadvantage is that one user can remove the whole system. Detection of an unauthorized lock, added by cutting the chain and inserting the lock, is very difficult with this system.

U.S. Pat. No. 2,707,125 to Ritter discloses a tubular multiple padlock system that mounts on a gatepost. U.S. Pat. No. 3,889,497 to Tuttle discloses a plate type multiple padlock device where padlocks must be used in multiples of four. U.S. Pat. No. 3,988,031 to Meyer and U.S. Pat. No. 4,997,219 to Carter disclose vertical wheel type multiple padlock devices where removal of a peripheral padlock provides access to a hole that allows retraction of a locking bar. U.S. Pat. No. 4,697,443 to Hillin discloses a horizontal wheel type multiple padlock device having radial access channels with a fastening gate for each padlock. U.S. Pat. No. 5,868,015 to Eaker discloses a multiple padlock system with a locking bar and a plurality of coupling segments. Each of the above patented devices is relatively complex and expensive.

Accordingly, there is a need for a simple multiple padlock system that cannot be readily removed by a single user. The multiple lock system should also prevent bypassing any user's padlock and addition of unauthorized padlocks. The system should be resistant to boltcutters and sledgehammers.

DISCLOSURE OF THE INVENTION

A multiple padlock lock system for locking a first post to a second post includes a common plate, means for locking the common plate to the second post, and a first connecting link portion with one or more connecting links. The common plate has two spaced common plate apertures for receiving the shackles of padlocks. The connecting links each have two spaced connecting link apertures holes for receiving the shackles of padlocks. The connecting links are connected by the shackles of padlocks to the common plate and to each other in series around a first post to lock the second post to the first post. The means for locking the common plate to the second post can include two additional spaced common plate apertures in the common plate and a second connecting link portion. The common plate can be mounted on the second post with a threaded fastener and the means for locking can include a detachable tongue plate. A tongue on tongue plate extends through the common plate and into the second post. Two spaced tongue plate apertures on the tongue plate align with the common plate apertures so that padlocks shackles in the two spaced common and tongue plate apertures lock the common and tongue plates together. The tongue prevents rotation of the common plate, locking the common plate to the second post.

BRIEF DESCRIPTION OF THE DRAWINGS

Details of this invention are described in connection with the accompanying drawings that bear similar reference numerals in which:

FIG. 3 is a top plan view of the common plate of the system of FIG. 1.

FIG. 4 is a side elevation view of a connecting link of the system of FIG. 1.

FIG. 5 is a side elevation view of another connecting link of the system of FIG. 1.

FIG. 6 is an exploded top plan view of alternative configuration of the system of FIG. 1.

FIG. 7 is a side elevation view of a connecting link of the system of FIG. 6.

FIG. 10 is a partial sectional view taken along line 10-10 of FIG. 9.

FIG. 11 is an exploded top plan view of the tongue and common plates of the system of FIG. 9.

FIG. 12 is an exploded front elevation view of the tongue and common plates of the system of FIG. 9.

FIG. 13 is a side elevation view of the common plate of the system of FIG. 9.

DETAILED DESCRIPTION OF THE INVENTION

Figure 1:
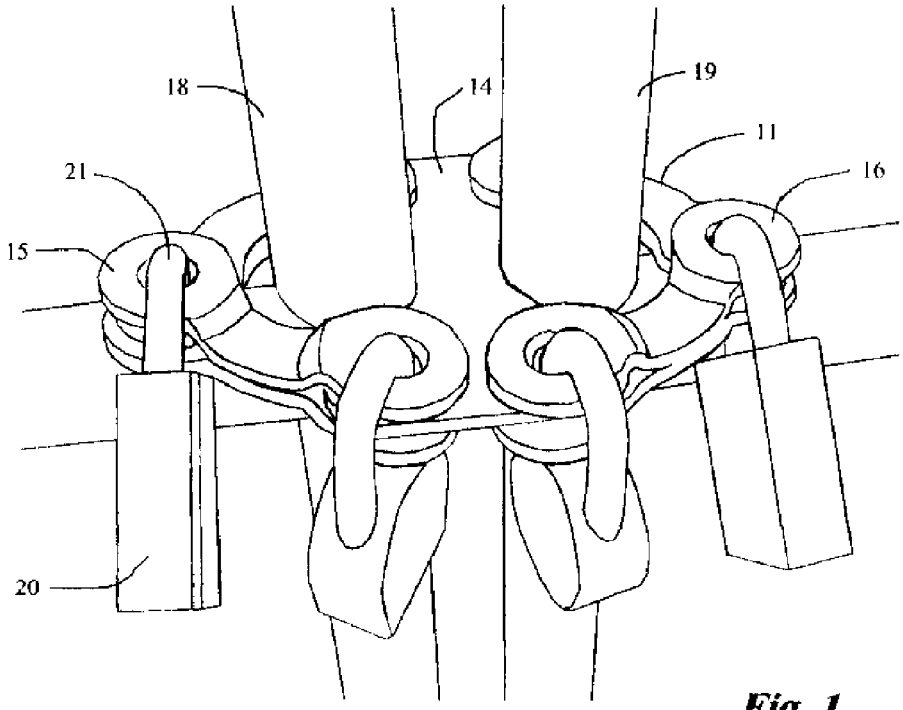
FIG. 1 is a perspective view of a multiple padlock lock system embodying features of the present invention, installed with padlocks on a first post and a second post.
Figure 2:
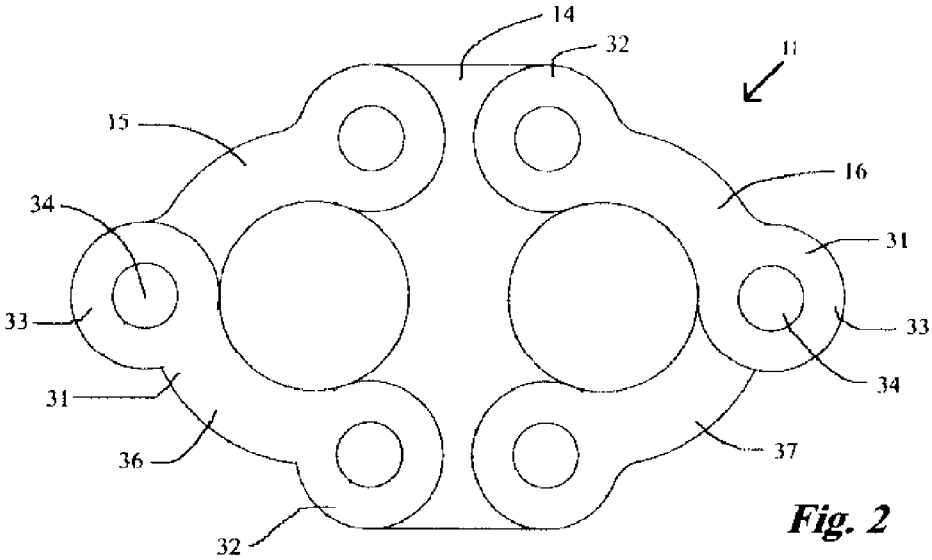
FIG. 2 is a top plan view of the system of FIG. 1.

Referring to FIGS. 1 to 5, a multiple padlock lock system 11, embodying features of the present invention, includes a common plate 14, and first and second connecting link portions 15 and 16. The lock system 11 locks a first post 18 to a second post 19 with the multiple padlocks 20 each having a shackle 21. By way of example, and not as a limitation, at least one of the first and second posts 18 and 19 will be a post on a gate and the other one of the first and second posts 18 and 19 can be a gate post or a post on a gate. The first and second posts 18 and 19 shown are vertical tubular steel posts.

Describing the specific embodiments herein chosen for illustrating the invention, certain terminology is used which will be recognized as being employed for convenience and having no limiting significance. For example, the terms "front", "back", "up", and "down" will refer to the illustrated embodiment in its normal position of use. Further, all of the terminology above-defined includes derivatives of the word specifically mentioned and words of similar import.

The common plate 14 shown is a flat, four sided, steel plate having a forward edge 23, a spaced rearward edge 24, and spaced first and second side edges 25 and 26 extending between the forward and rearward edges 23 and 24. The common plate 14 includes a pair of spaced common plate apertures 28 spaced inwardly from the first side edge 25 and a pair of spaced common plate apertures 28 spaced inwardly from the second side edge 26. The common plate apertures 28 extend through the common plate 14 and are sized to receive the shackles 21 of padlocks 20. The first and second side edges 25 and 26 each have a concave section 29, between the common plate apertures 28, sized and shaped to receive one of the first or second posts 18 or 19.

The first and second connecting link portions 15 and 16 each have two connecting links 31. Each connecting link 31 has a first end 32, a spaced second end 33 and a connecting link aperture 34 at each of the first and second ends 32 and 33. The connecting link apertures 34 extend through the connecting links 31 and are sized to receive the shackles 21 of padlocks 20. The connecting links 31 shown are curved to encircle or wrap around the first post 18 or the second post 19.

The connecting links 31 for the first and second connecting link portions 15 and 16 are shown as a first connecting link 36 and a second connecting link 37. The first and second ends 32 and 33 of the first connecting link 36 each include an upper section 39 and a spaced lower section 40. The first end 32 of the second connecting link 37 includes an upper section 39 and a spaced lower section 40. The second end 33 of the second connecting link 37 is flat and has the thickness of the remainder of the second connecting link 37. The connecting link apertures 34 extend through the upper and lower sections 39 and 40. The upper and lower sections 39 and 40 are spaced apart by a sufficient distance that the common plate 14 or the second end 33 of the second connecting link 37 will fit between the upper and lower sections 39 and 40.

The connecting links 31 of the first connecting link portion 15 are positioned around the first post 18, and connected together and to the common plate 14 by the shackles 21 of padlocks 20 through the connecting link and common plate apertures 34 and 28, to lock the common plate 14 to the first post 18. The connecting links 31 of the second connecting link portion 16 are positioned around the second post 19, and connected together and to the common plate 14 by the shackles 21 of padlocks 20 through the connecting link and common plate apertures 34 and 28, to lock the common plate 14 to the second post 19. The second connecting link portion 16 is a means for locking the common plate 14 to the second post 19.

The lock system 11 shown in FIGS. 1-5 uses six padlocks. At least one connecting link 31 and two padlocks 20 are needed for each of the first and second connecting link portions 15 and 16. The lock system 11 can be configured or tailored to use almost any desired number of padlocks 20. The common plate 14 and connecting links 31 are preferably made from flat steel stock and are difficult to cut with bolt cutters. When one padlock 20 is unlocked, the lock system 11 remains locked to either the first post 18 or the second post 19, preventing loss of the locking system 11 and the other padlocks 20.

Figure 8:
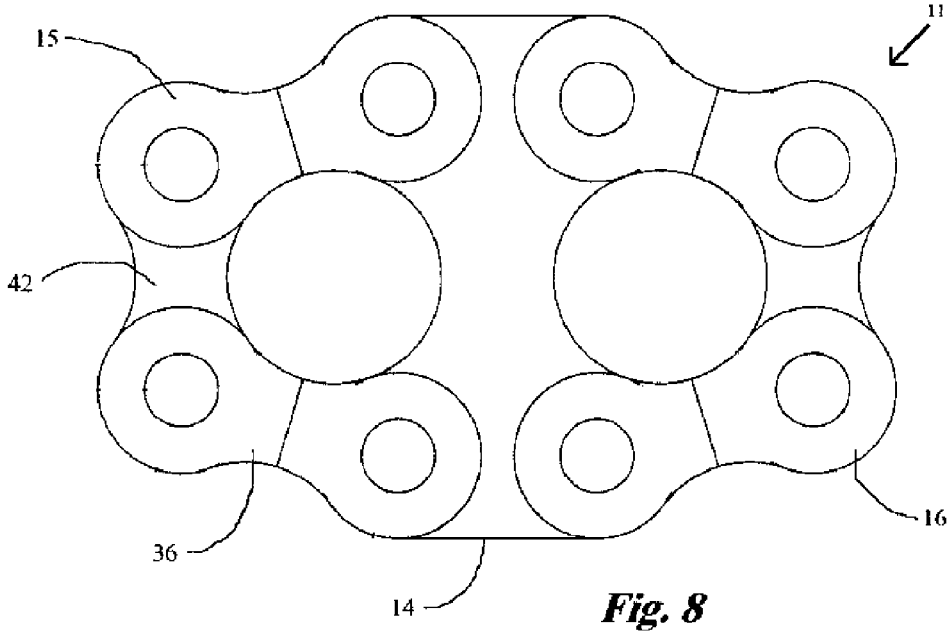
FIG. 8 is a top plan view of alternative configuration of the system of FIG. 1.

FIGS. 6 and 7 show a lock system 11 for use with four padlocks. The first and second connecting link portions 15 and 16 each consist of a single first connecting link 36, with the first and second ends 32 and 33 of each first connecting link 36 each including an upper section 39 and a spaced lower section 40. The first connecting links 36 curve around to encircle the first or second post 18 or 19. FIG. 8 shows a lock system 11 for use with eight padlocks. The first and second connecting link portions 15 and 16 each have three connecting links 31, two first connecting links 36 and a flat third connecting link 42.

Referring to FIGS. 9 to 13, a multiple padlock lock system 44, embodying features of the present invention, includes a common plate 46, a first connecting link portion 47, a tongue plate 48 and a carriage bolt 49. The common plate 46 has a substantially flat first portion 51 between spaced first and second side edges 52 and 53, and a second portion 55 that projects upwardly from the second side edge 53.

A receiving aperture 56, spaced from the first portion 51, extends through the second portion 55. A threaded nut 57, aligned with the receiving aperture 56 and sized to receive the carriage bolt 49, is rigidly affixed to the second portion 55 by welding. The carriage bolt 49 is sized to extend through a first post aperture 58 through the second post 19. The common plate 46 is mounted on the second post 19 by placing the carriage bolt 49 through the first post aperture 58, placing the common plate 46 on the second post 19 with the carriage bolt 49 extending through the receiving aperture 56 and rotating the common plate 46 to thread the nut 57 onto the carriage bolt 49.

The carriage bolt 49 and the nut 57 are a tamper resistant fastener and a means for receiving the fastener. Other tamper resistant fasteners and means for receiving the fastener can be used. By way of example, and not as a limitation, a tapped, thread receiving aperture can be the means for receiving the fastener instead of nut 57. Also by way of example, and not as a limitation, a threaded stud mounted on the second portion 55 and sized to extend the second post 19 in combination with a threaded T-nut can be used as a tamper resistant fastener and a means for receiving the fastener.

The common plate 46 includes a pair of spaced common plate apertures 60 spaced inwardly from the first side edge 52. The common plate apertures 60 extend through the first portion 51 of the common plate 46 and are sized to receive the shackles 21 of padlocks 20. A tongue aperture 61 extends through the second portion 55 of the common plate 46, adjacent to the first portion 51.

The tongue plate 48 includes a base portion 63 sized and shaped to fit over the first portion 51 of the common plate 46 and a tongue portion 64 that projects from the base portion 63. The tongue portion 64 is sized and positioned to extend through the tongue aperture 61 in the second portion 55 of the common plate 46. The tongue portion 64 projects beyond the second portion 55 of the common plate 46 and into a second post aperture 66, that is spaced from the first post aperture 58.

Two spaced tongue plate apertures 67 extend through the base portion 63 of the tongue plate 48 and align with the common plate apertures 60. The tongue plate apertures 67 are sized to receive the shackles 21 of padlocks 20. A common plate screw aperture 69 extends through the first portion 51 of the common plate 46. The tongue plate 48 has a tapped tongue plate screw aperture 70 that aligns with the common plate screw aperture 69. A cap screw 71 is inserted through the common plate screw aperture 69 and threaded into the tongue plate screw aperture 70 to secure the tongue plate 48 to common plate 46.

The tongue plate 48 is a means for locking the common plate 46 to the second post 19. When the tongue plate 48 is mounted on the common plate 46, the tongue portion 64 in the second post aperture 66 prevents rotation of the common plate 46. The tongue plate 48 cannot be removed from the common plate 46 without removing the shackles 21 of padlocks 20 from both common plate apertures 60.

Figure 9:
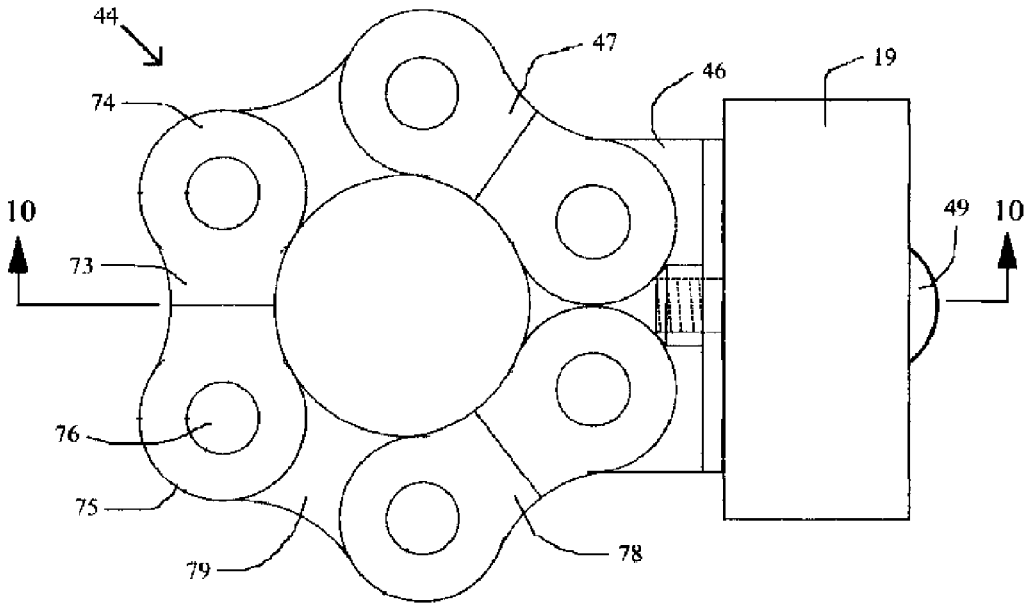
FIG. 9 is a top plan view of another multiple padlock lock system embodying features of the present invention.

FIG. 9 shows a lock system 44 for six padlocks with the first connecting link portion 47 having five connecting links 73. Each connecting link 73 has a first end 74, a spaced second end 75 and a connecting link aperture 76 at each of the first and second ends 74 and 75. The connecting link apertures 76 extend through the connecting links 73 and are sized to receive the shackles 21 of padlocks 20. The connecting links 73 include three first connecting links 78 and two second connecting links 79.

Figure 15:
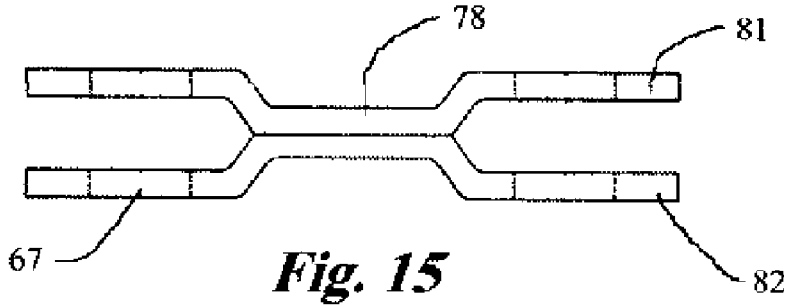
FIG. 15 is a side elevation view of a connecting link of the system of FIG. 14.
Figure 16:
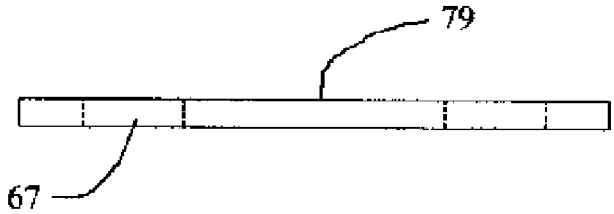
FIG. 16 is a side elevation view of another connecting link of the system of FIG. 14.

The first and second ends 74 and 75 of the first connecting links 78 each include an upper section 81 and a spaced lower section 82, as shown in FIG. 15. The second connecting links 79 are substantially flat, as shown in FIG. 16. The connecting link apertures 76 extend through the upper and lower sections 81 and 82. The upper and lower sections 81 and 82 are spaced apart by a sufficient distance that the common plate 46 or the first or second end 74 or 75 of the second connecting link 79 will fit between the upper and lower sections 81 and 82.

Figure 14:
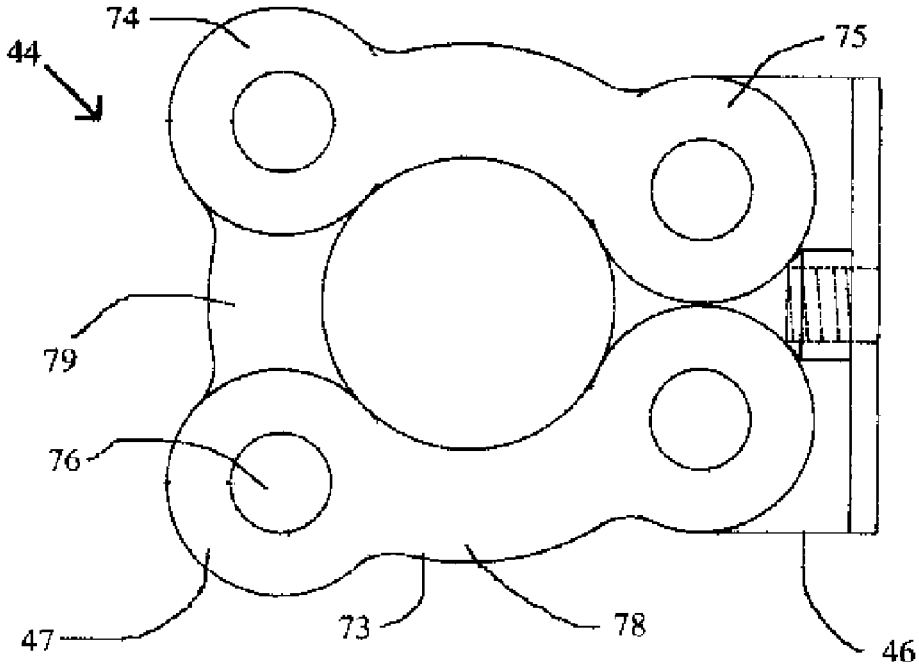
FIG. 14 is a top plan view of an alternative configuration of the system of FIG. 9.

FIG. 14 shows a lock system 44 for four padlocks with the first connecting link portion 47 having three connecting links 73. The connecting links 73 include two first connecting links 78 and one second connecting link 79. The lock system 44 can include any number of connecting links 73, from one up. When one padlock 20 is unlocked, the lock system 44 remains locked to the second post 19, preventing loss of the locking system 44 and the other padlocks 20.

Although the present invention has been described with a certain degree of particularity, it is understood that the present disclosure has been made by way of example and that changes in details of structure may be made without departing from the spirit thereof.

What is claimed is:

1. A multiple padlock lock system for locking a first post to a second post with a plurality of padlocks, comprising:

a common plate having spaced first and second side edges and two spaced common plate apertures spaced inwardly from said first side edge, said common plate apertures being sized to each receive a padlock shackle, means, connected to said common plate, for locking said common plate to said second post, and a first connecting link portion having at least one connecting link, each said connecting link having a first end, a spaced second end and a connecting link aperture at each of said first and second ends, said connecting link apertures being sized to each receive a padlock shackle, said first connecting link portion being sized and shaped to partially encircle said first post, whereby said padlocks are received in said common plate apertures and said connecting link apertures to connect said first connecting link portion and said common plate around said first post to lock said first post to said second post.

2. The lock system as set forth in claim 1 wherein said common plate is a substantially flat metal plate and includes two spaced common plate apertures spaced inwardly from said second side edge.

3. The lock system as set forth in claim 2 wherein said means for locking includes a second connecting link portion having at least one connecting link, said second connecting link portion being sized and shaped to partially encircle said second post, whereby said padlocks are received in said common plate apertures on said second side edge and said connecting link apertures to connect said second connecting link portion and said common plate around said second post to lock said common plate to said second post.

4. The lock system as set forth in claim 1:

including a tamper-resistant threaded fastener, and wherein said common plate includes a substantially flat first portion between said first and second side edges, a second portion extending from said second side edge transverse to said first portion and means, on said second portion, for receiving said fastener, whereby one of said fastener and said means for receiving extends through said second post and said common plate is rotated to thread said fastener and said means for receiving together to mount said common plate on said second post.

5. The lock system as set forth in claim 4 wherein:

said second portion of said common plate includes a tongue aperture adjacent to said first portion, and said means for locking includes a tongue plate having a base portion sized and shaped to fit over said first portion of said common plate and a tongue portion extending from said base portion, said tongue portion being sized and shaped to fit through and extend beyond said tongue aperture, said base portion having two spaced tongue plate apertures aligned with said common plate apertures, whereby said tongue portion extends into said second post to prevent rotation of said common plate and padlocks through said common and tongue plate apertures lock said tongue plate to said common plate.

6. The lock system as set forth in claim 4 wherein said fastener is a carriage bolt sized to extend through said second post, and said means for receiving includes a receiving aperture through said second portion of said common plate and a nut affixed onto said second portion at said receiving aperture.

7. The lock system as set forth in claim 1 wherein said first side edge of said common plate includes a concave section between said common plate apertures, said concave section being sized and shaped to partially receive said first post.

8. The lock system as set forth in claim 1 wherein said first connecting link portion has a single connecting link, said connecting link being shaped to encircle said first post from one said common plate aperture to the other said common plate aperture, said first and second ends of said connecting link each having an upper section and a spaced lower section with said connecting link aperture extending through said upper and lower sections, whereby said upper sections of said first and second ends extend over said common plate and said lower sections of said first and second ends extend under said common plate when said connecting link is connected to said common plate with said padlocks.

9. The lock system as set forth in claim 1 wherein said first connecting link portion has a first connecting link and a second connecting link, said first and second ends of said first connecting link each having an upper section and a spaced lower section with said connecting link aperture extending through said upper and lower sections, and said first end of said second connecting link having an upper section and a spaced lower section with said connecting link aperture extending through said upper and lower sections.

10. The lock system as set forth in claim 1 wherein said first connecting link portion has two first connecting links and a second connecting link, said first and second ends of said first connecting links each having an upper section and a spaced lower section with said connecting link aperture extending through said upper and lower sections, and said second connecting link having a flat plate shape.

11. A multiple padlock lock system for locking a first post to a second post with a plurality of padlocks, comprising:

a flat metal common plate having spaced first and second side edges, two spaced common plate apertures spaced inwardly from said first side edge, and two spaced common plate apertures spaced inwardly from said second side edge, said common plate apertures being sized to each receive a padlock shackle, said first and second side edges each having a concave section between said common plate apertures, and first and second connecting link portions each having at least one connecting link, each said connecting link having a first end, a spaced second end and a connecting link aperture at each of said first and second ends, said connecting link apertures being sized to each receive a padlock shackle, said first connecting link portion being sized and shaped to partially encircle said first post, and said second connecting link portion being sized and shaped to partially encircle said second post, whereby said padlocks are received in said common plate apertures and said connecting link apertures to connect said first connecting link portion and said common plate around said first post and said second connecting link portion and said common plate around said second post to lock said first post to said second post.

12. A multiple padlock lock system for locking a first post to a second post with a plurality of padlocks, comprising:

a common plate having spaced first and second side edges, a substantially flat first portion between said first and second side edges, a second portion extending from said second side edge transverse to said first portion, two spaced common plate apertures spaced inwardly from said first side edge, a tongue aperture through said second portion adjacent to said first portion, a receiving aperture through said second portion and a nut welded onto said second portion at said receiving aperture, said common plate apertures being sized to each receive a padlock shackle, a tongue plate having a base portion sized and shaped to fit over said first portion of said common plate and a tongue portion extending from said base portion, said tongue portion being sized and shaped to fit through and extend beyond said tongue aperture, said base portion having two spaced tongue plate apertures aligned with said common plate apertures, and a first connecting link portion haying at least one connecting link, each said connecting link having a first end, a spaced second end and a connecting link aperture at each of said first and second ends, said connecting link apertures being sized to each receive a padlock shackle, said first connecting link portion being sized and shaped to partially encircle said first post, whereby said padlocks are received in said common plate apertures and said connecting link apertures to connect said first connecting link portion and said common plate around said first post to lock said first post to said second post.

* * * * *